US006997489B2

(12) United States Patent
De Lima Castro

(10) Patent No.: US 6,997,489 B2
(45) Date of Patent: Feb. 14, 2006

(54) PULL-TIGHT ONE-PIECE SECURITY SEAL, ADAPTED FOR THE CLOSURE OF BAGS OR THE LIKE

(75) Inventor: Andre De Lima Castro, Rio de Janeiro (BR)

(73) Assignee: Starlock Industria E Comercio LTDA, RJ (BR)

( * ) Notice: Subject to any disclaimer, the term of this patent is extended or adjusted under 35 U.S.C. 154(b) by 86 days.

(21) Appl. No.: 10/380,912

(22) PCT Filed: Sep. 21, 2001

(86) PCT No.: PCT/BR01/00118

§ 371 (c)(1),
(2), (4) Date: Jun. 16, 2003

(87) PCT Pub. No.: WO02/25621

PCT Pub. Date: Mar. 28, 2002

(65) Prior Publication Data

US 2004/0006852 A1 Jan. 15, 2004

(30) Foreign Application Priority Data

Sep. 21, 2000 (BR) ..... 0004354

(51) Int. Cl.
*G09F 3/03* (2006.01)

(52) U.S. Cl. ..... 292/307 A; 292/323

(58) Field of Classification Search ..... 292/329, 292/330, 328, 307 A, 323, 324; 24/30.5 P, 24/16 PB, 17 AP See application file for complete search history.

(56) References Cited

U.S. PATENT DOCUMENTS 1,821,418 A * 9/1931 Brooks ..... 292/325
2,800,349 A * 7/1957 Moberg ..... 292/325
2,954,621 A * 10/1960 Mosher Jr. ..... 40/633
3,020,657 A * 2/1962 Clark ..... 40/633
3,656,247 A * 4/1972 Bushnell et al. ..... 40/633
3,708,835 A * 1/1973 Bienz ..... 24/16 PB
3,751,835 A * 8/1973 Smith ..... 40/633
4,711,002 A 12/1987 Kreeger
5,395,343 A 3/1995 Iscovich
5,457,853 A * 10/1995 Klein ..... 24/16 PB
5,765,885 A * 6/1998 Netto ..... 292/318
5,788,294 A * 8/1998 Leon et al. ..... 292/307 R
5,964,013 A * 10/1999 Bergstrom ..... 24/16 PB
6,494,508 B1 * 12/2002 Dreisbach et al. ..... 292/307 R

FOREIGN PATENT DOCUMENTS

GB 2 090 628 A 7/1982
GB 2 135 382 A 8/1984

* cited by examiner

*Primary Examiner*—Gary Estremsky
(74) *Attorney, Agent, or Firm*—Finnegan, Henderson, Farabow, Garrett & Dunner, L.L.P.

(57) ABSTRACT

A one-piece pull-tight or strap-type security seal adapted for closing bags or the like that is designer to be easily applied in comparison with existing ones. One seal of this type has a lever operation in which a clousure strap (4) is integral with a central or operating portion (2) that is, in turn, integral with a lever member (6) to which the strap may be fixed during application around the neck of a bag to be closed. The lever member is then pivoted outwardly and backwardly over the opening portion, tightening the loop so formed by means of a lever action, and then locked by security locking formations (16, 19) to effect sealing. The closure strap is for all effects flat, its formations for fixing it to the lever member (6) including a series of orifices (7) distributed along its length, whereas the immobilizing formation for the closure strap includes a first protuberance (15) adapted, on formation of the loop (25), to be received in one of the orifices (7). The operating member (2) may be provided with an elastic hook (24) that, in the closed position of the seal, passes through another of the orifices (7) in the closure strap so as to maintain the seal closed even if the locking formations are damaged or broken. A separate seal (26) is also described, in one embodiment, so as to permit uses of the one-piece seal (1) after the first use when the securing locking formations (16, 19) have already been damaged or broken.

10 Claims, 7 Drawing Sheets

PULL-TIGHT ONE-PIECE SECURITY SEAL, ADAPTED FOR THE CLOSURE OF BAGS OR THE LIKE

The present invention refers to a pull-tight or strap-type security seal, adapted for the closure of bags or the like.

DESCRIPTION OF THE PRIOR ART

Pull-tight or strap-type security seals that are specially suitable for the closure of the neck or mouth of bags and the like are already known. Such type of seal is better exemplified by that disclosed and illustrated in Brazilian Patent PI8100037 and its corresponding Canadian Patent 1,222,131. This known seal comprises an operating portion integral, at its two ends, with a closure strap and a lever member. The lever member is foldable over the operating member and can be locked in this position by locking formations on the respective portions. The closure strap comprises a thread having a series of ball- or sphere-type formations along its length. During placement of the seal, the strap is passed around the neck of the bag to be closed and sealed, forming a loop. It is then passed through a guide slot in the operating portion to guide it to the lever member where it is inserted through a keyhole opening in the lever member. The seal is then manually tightened to close the neck of the bag and the length of the loop thus tightened is determined by manipulating the strap so that the part of the strap that remains between ball-type formations is fitted into the narrow part of the keyhole opening. This operation requires some skill by the user, especially since the ball-type formations have to be suitably manipulated for them to pass through the guide slot.

The seal of Brazilian Patent P18100037 is then closed by folding the lever member outwardly and backwardly over the operating portion, thus further tightening the loop with a minimum of manual effort, and pressing it against the operating portion to engage a security closure mechanism, part of the closure strap then being hidden and inaccessible from the outside since it lies between the lever member and the operating portion. Once more, the fact that there are ball-type formations on the closure strap results in a relatively bulky closure device.

The seal is opened by cutting the closure strap and it is thus utilized. It is therefore of necessity a throw-away type.

For these and other reasons security seals of the type in question are difficult to apply and have not met with much success on the market.

OBJECTS OF THE PRESENT INVENTION

The main object of the present invention is to overcome the inconveniences indicated above by means of a pull-tight security seal, be it one-piece or not, that is easy to apply without prejudicing the security of the closure.

Another object of this invention is to make it possible to re-use a seal of this type, after a first use, as a simple non-security pull-tight or strap-type closure device.

A further object of the invention is to make it possible to re-use the seal, still as a security seal but together with a small additional security seal.

BRIEF DEFINITION OF THE PRESENT INVENTION

According to the present invention a security seal of the above type has a closure strap that is substantially planar, its locking formations comprising a series of orifices distributed along its length, whereas the formation for immobilising the strap on the lever member comprises a first protuberance which, when the loop is formed, is adapted to be received in one of such orifices.

Preferably, the said first protuberance includes a hook which, when the loop is formed, passes through said orifice and engages the surface of the strap facing away from the operating portion.

The security locking formation on the lever member advantageously comprises a second protuberance in the form of a locking tooth adapted to pass through another of the orifices in the closure strap, and the corresponding locking formation on the operating portion comprises a cavity adapted to receive such locking tooth in locking relationship when the seal is closed.

The locking tooth, in the preferred embodiment of the invention, has a base fixed to the lever member, which is weakened so as to break when the seal is intentionally opened, leaving a corresponding opening in the lever member. This greatly facilitates the authorised opening of the seal.

In order to make the seal re-usable, but still as a security seal, it may be used in combination with a separate seal to seal it during uses subsequent to the first use, when the said locking tooth as already been broken. In accordance with this aspect of the invention, the separate security seal comprises a plate to be placed over the lever member when the seal is in the closed configuration for subsequent uses, and a protuberance in the form of a locking tooth substantially identical to the locking tooth that was broken, the locking tooth on the separate security seal also having a weakened base that can be broken on subsequent opening of the original seal.

In accordance with another aspect of the invention, the operating portion of the seal has an elastic locking tooth adapted, in the closed configuration of the seal, to pass through one of the orifices in the closure strap and engage the strap so as to maintain the seal closed, this one-piece seal thus being suitable for use as a simple closure device without any security characteristics, after the locking tooth on the lever member has been broken.

BRIEF DESCRIPTION OF THE DRAWINGS

The invention will be better understood from the following description, given by way of example, of presently preferred embodiments, reference being made to the accompanying drawings, in which.

DETAILED DESCRIPTION OF THE DRAWINGS

Figure 1:
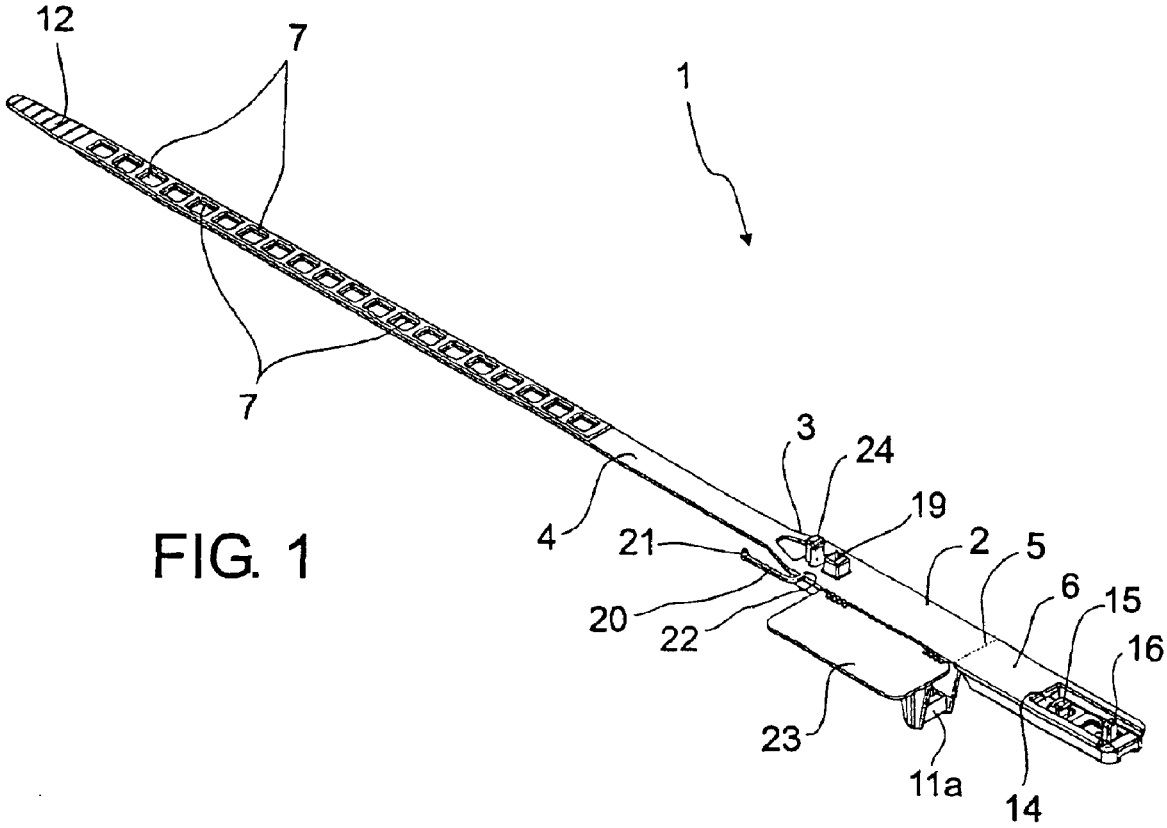
FIG. 1 is an upper perspective view of a pull-tight or strap type one-piece security seal, according to amp-referred embodiment of this invention.
Figure 2:
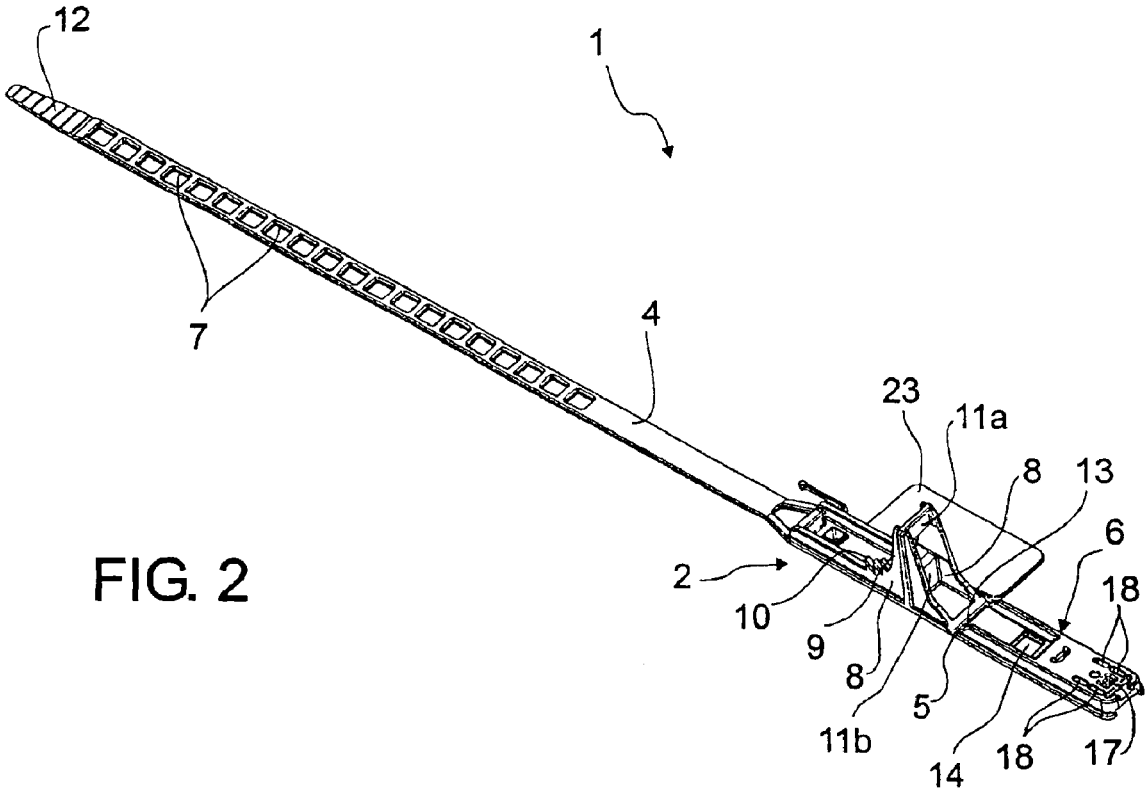
FIG. 2 is a lower perspective view of the seal illustrated in FIG. 1.

Referring first to FIGS. 1 and 2 of the drawings, a one-piece security seal 1 in the form of a presently preferred embodiment of this invention, comprises a single part molded in plastics material. The seal is constituted of a central operating portion 2 having a first end 3 integral with a closure strap 4, and a second end 5 integral with a lever member 6.

The closure strap has pointed free end and, along its length, a series of equally interspaced identical rectangular orifices 7. The operating portion 2 has a generally planar outer side and an inner side formed with two flanges 8 that are perpendicular to the remaining part of portion 2 and parallel to each other. Flanges 8 are identical and each has a concave edge 9 facing the closure strap and formed with retaining teeth 10. The two concave edges 9 with their teeth 10 define a retaining region together with the neck of a bag or the like when the seal is being used, as will become clear later. The top region of flanges 8, that is to say, the region furthest from the rest of portion 2, are joined by two struts 11*a* and 11*b*, defining a passage through which the free end 12 of closure strap 4 can be inserted, so as to form a loop essentially comprised by a length of strap 4 and the retaining region of operating portion 2 of the seal. Lever member 6 is joined to the second end 5 of the operating portion 2 by means of a weakened or hinge line 13 so that it can be folded outwardly over portion 2. At a certain distance from hinge line 13, the lever member has an opening 14 through which the closure strap 4 can be passed. On the outer side of the lever member and slightly more distant from the hinge line, there is a small tooth 15 facing away from the operating portion 2. In this way, on forming the loop with the closure strap 4, end 12 of strap 4 may be introduced through opening 14 and pulled so as to tighten the loop around the neck of a bag or other article to be sealed, and then tooth 15 may pass through one of the rectangular orifices 7 in the strap so as to determine the length of the loop.

Near the free end of lever member 6, on its outer side, there is a small locking tooth 17 having a weakened base 17 that joins the tooth 16 to member 6. This base 17 is dimensioned so that, when it is broken, it leaves an opening substantially equal to the cross section of the tooth.

The distance between tooth 15 and tooth 16 is a multiple of the distance between orifices 7 in the closure strap 4, so that the tooth can pass through one of those orifices when seal 1 is closed.

There are two slots 18 on each side of locking tooth 16, the purpose of which will be described later.

Operating portion 2 is provided with a locking cavity 19 formed with a protuberance on its upper or outer side, serving to receive the locking tooth 16 and thus effect locking of seal 1 when the lever member 6 is totally folded outwardly and backwardly and squeezed against portion 2.

There are also two accessories on the operating portion 2. On one side of portion 2, near end 3, a short thread 20 provided with a small pin 21 that can be fitted into a small corresponding orifice 22 in portion 2 at its free end, serves to attach an address label or the like to seal 1.

On the same side of portion 2, a second accessory is in the form of an identification plate 23, joined to portion 2 by means of a line of weakening. This plate carries an identification or personalisation of seal 1 by means of a individualised number, both in Arabic numerals and in bar code.

Finally, operating portion 2 of the a seal is provided externally and adjacent its first end 3, with a protuberance in the form of an elastic tooth 24, the purpose of which will later become clear.

Figure 3:
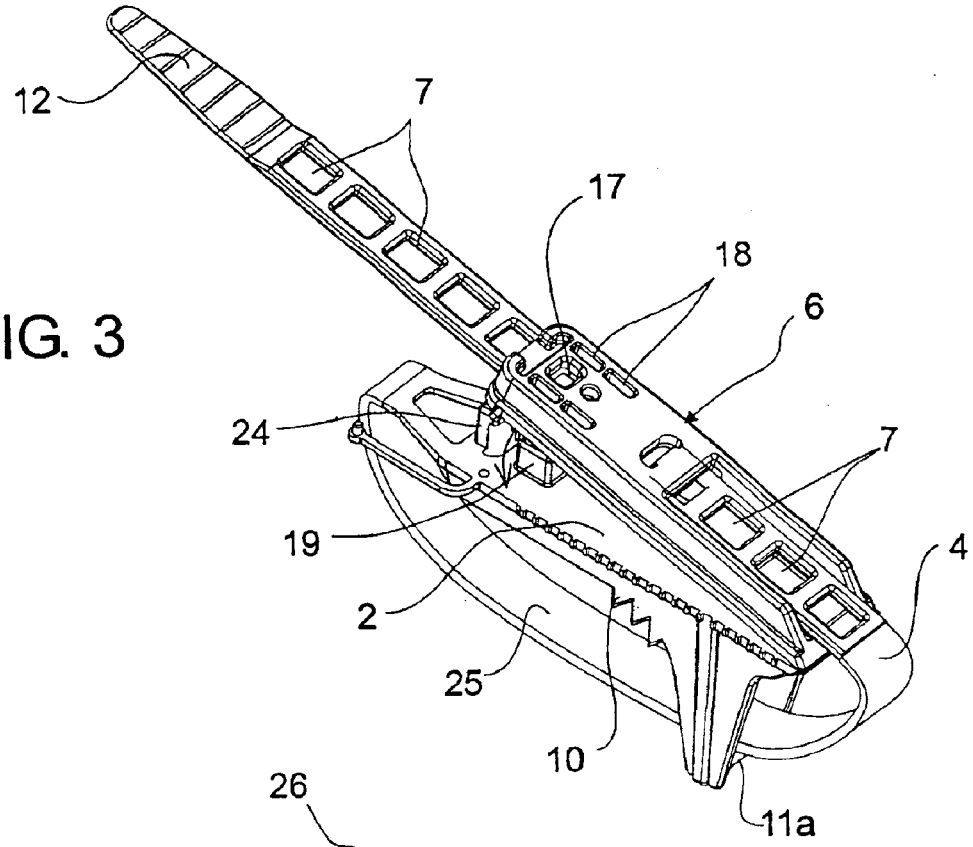
FIG. 3 is a perspective view of the same seal at the moment of closure.

FIG. 3 shows the seal at the moment of closure. End 12 of closure strap 4 has already been inserted through the passage formed between the struts 11*a* and 11*b* and threaded through opening 14 in lever member 6. End 12 was then pulled to tighten the loop 25 formed around the neck of a bag (not shown for clarity), after which tooth 15 was fitted through one of the orifices 7 in the strap, thus determining the length of strap 4 to be used in closure of the neck of the bag, with a first manual tension. With the remaining part of strap 4 laid along the external side of lever member 6, this latter was then folded outwardly and backwardly over operating portion 2, so that the configuration shown in FIG. 3 could be assumed. As this operation was carried out, the thickness of lever 6 created a small lever arm with respect to hinge line 13, producing a final tightening of loop 25, ensuring in this manner considerable tightening of the neck of the bag being closed.

Starting from the configuration of FIG. 3, lever member 6 is pressed against operating portion 2 so that locking tooth 16 can enter cavity 19 where it becomes locked in place, sealing seal 1. At this instant the elastic tooth 24 passes through one of the orifices 7 in closure strap 4, hooking itself onto one of the edges of that orifice. In this way the seal is closed and the bag sealed with a seal personalised with the number on identification plate 23.

When the bag reaches its destination and opening is authorised, it is sufficient to pull the free end of closure strap 4 away from the bag for base 17 of locking tooth 16 to break, for the tooth to fall and the lever member, as already mentioned, to be left with an opening having the dimensions of the fallen tooth.

Notwithstanding the fact that the sealing system has already been broken, seal 1—according to one aspect of the invention—can still be used on further occasions, either as a seal or as a simple closure device without any security characteristics. Firstly, the identification plate 23 may be removed by tearing it off along the line of weakening. The device may then be applied to another bag and closed, with any degree of security, thanks to the closure that is assured by elastic tooth 24 that receives the end of lever member 6.

Figure 4:
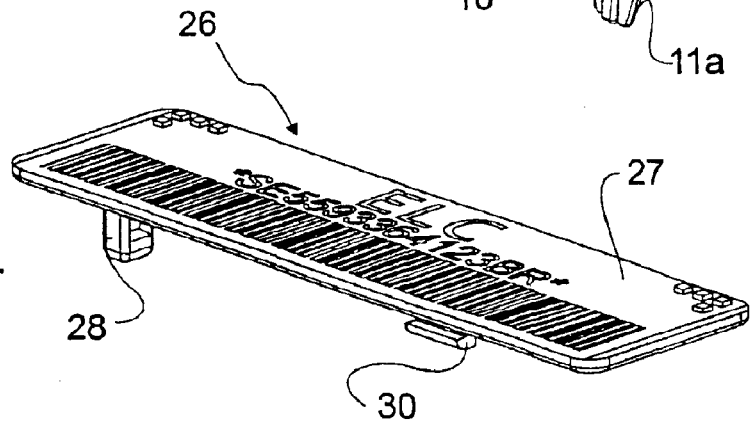
FIG. 4 is an upper perspective view of a special seal to be used on a subsequent use of the seal illustrated in FIGS. 1 to 3.
Figure 5:
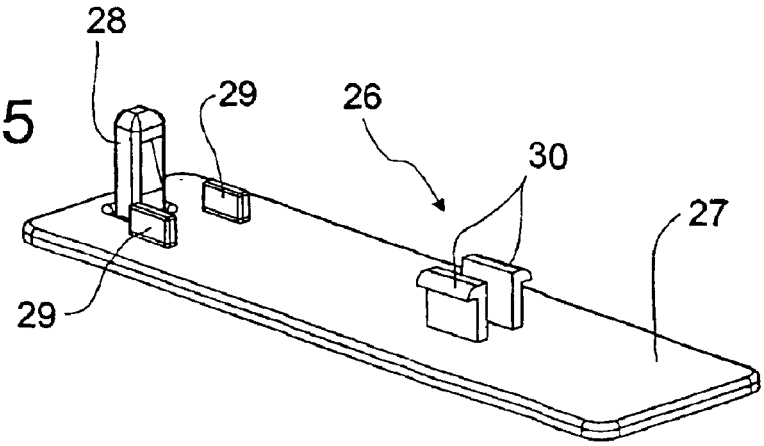
FIG. 5 is a lower perspective view of the special seal illustrated in FIG. 4.

Alternatively, seal 1 may be re-used as a security seal using the small special seal 26 illustrated in FIGS. 4 and 5. As shown in those figures, special seal 26 comprises a plate 27 having dimensions substantially identical to those of the outer side of lever member 6. On the outside of plate 27, there is an identification number similar to that of plate 23 that was removed after the first use of seal 1. Once more, this number is unique and serves to personalise the combination formed by seals 1 and 26.

Figure 6:
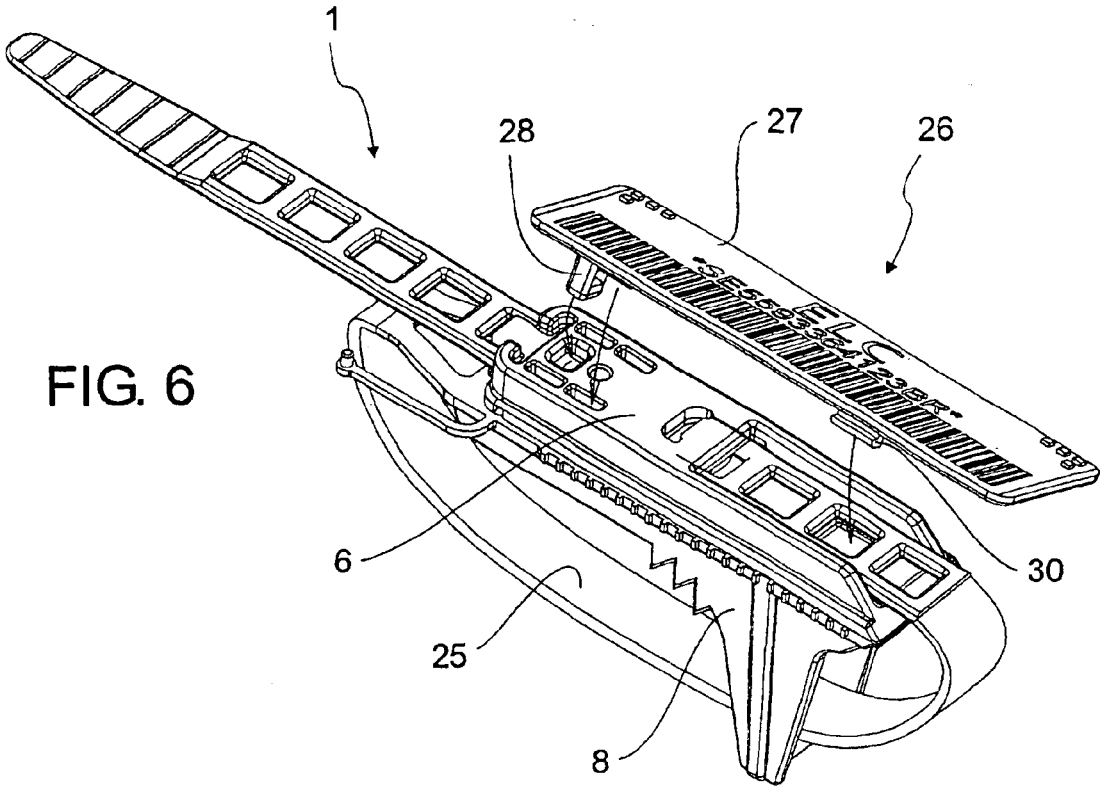
FIG. 6 shows, in perspective, the act of sealing closure of the seal of FIGS. 1 to 3, when it is re-used with employment of the special seal of FIGS. 4 and 5.

On the inner or underside of plate 27, there is a locking tooth 28 identical to tooth 16, that also has a breakable base. Near tooth 28 there is a pair of positioning bosses 29 and, longitudinally spaced therefrom, a pair of elastic hooks 30. On closure of seal 1 in the manner described above with the engagement of the end of lever member 6 on elastic hook 24, the special seal 26 may be applied with locking tooth 28 entering cavity 19 in portion 2, through the opening left in lever member 6 by the breakage of tooth 16 when the seal was first opened. The positioning bosses 29 will enter the two slots 18 and the elastic hooks 30 will pressure fit into one of the orifices 7 in the closure strap 4, all as illustrated in FIG. 6.

Figure 7:
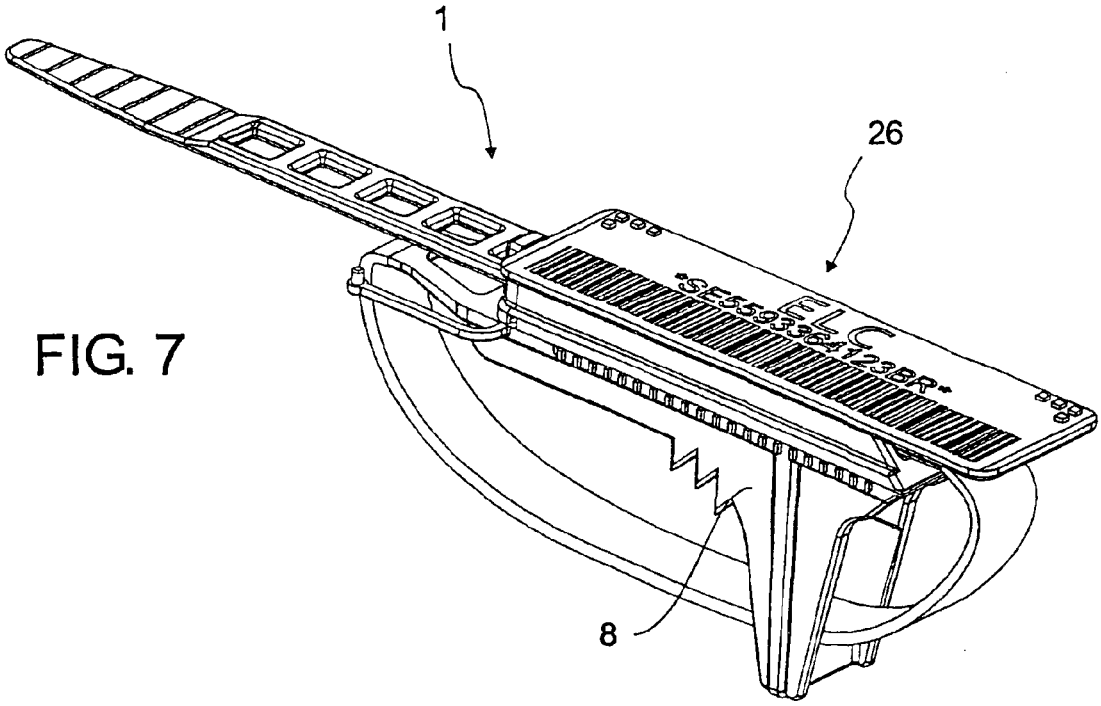
FIG. 7 shows the seal of FIGS. 1 to 3 already closed and sealed with the seal of FIGS. 4 and 5.

FIG. 7 shows the final configuration of seal 1 when sealed in its closed position by application of special seal 26.

It will, be understood that seal 1 of the present invention is an extremely versatile device because:

for its first use it is a one-piece security seal, that is to say, it may be closed and sealed as a single part without any thread or cord to close the bag or, furthermore, any separate element at all to effect sealing;

for later uses, it can be used again as a security seal by using a second seal of very simple manufacture and reduced cost; and for later uses, it can also be used as a simple pull-tight tie device without any security characteristics.

Apart from this, seal 1 is extremely easy and practical to apply. The passage defined between struts 11*a* and 11*b* greatly facilitates formation of the loop around the neck of the bag to be closed. The fact that the closure strap 4 then passes through an opening in the lever member 6 where, after an initial manual tightening, it is caught onto hook 15, also facilitates handling of the seal during its application. Handling is further facilitated by the fact that closure strap 4 is smooth, there being no unnecessary protuberances for fixing it on closure of the device, as ocurred in the prior art.

In addition, the lever arm defined by the configuration as described permits the user to apply an excellent final tightening on folding lever member 6 outwardly and backwardly in preparation for closure of the seal.

Finally, the use of tooth 16 with its weakened base 17 promotes a very simple manual opening of the seal, and thus of the bag, without the use of special tools or scissors and consequently without any risk of damaging the bag.

These and other advantages will be apparent to a person versed in the art.

Figure 8:
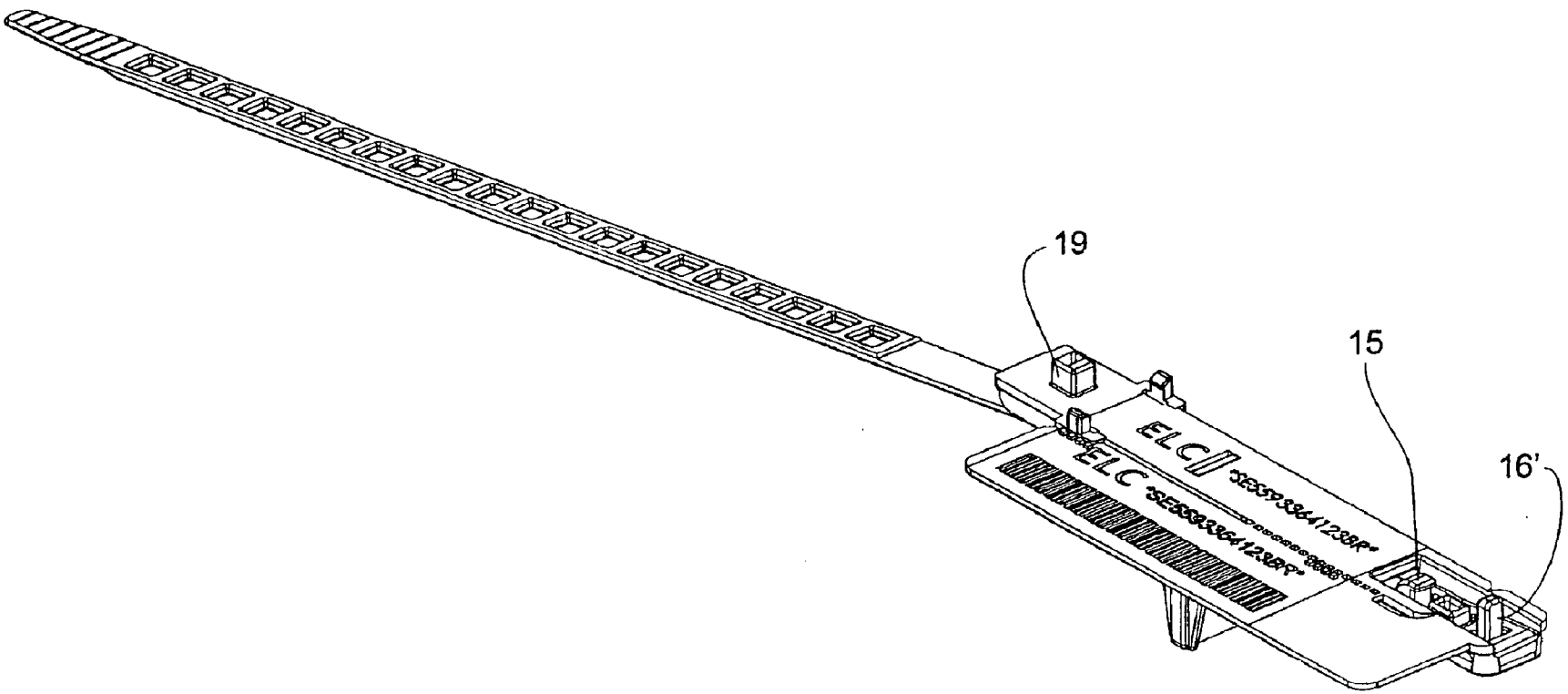
FIG. 8 is an upper perspective view, similar to FIG. 1, showing a second embodiment of the security seal according to the present invention.
Figure 9:
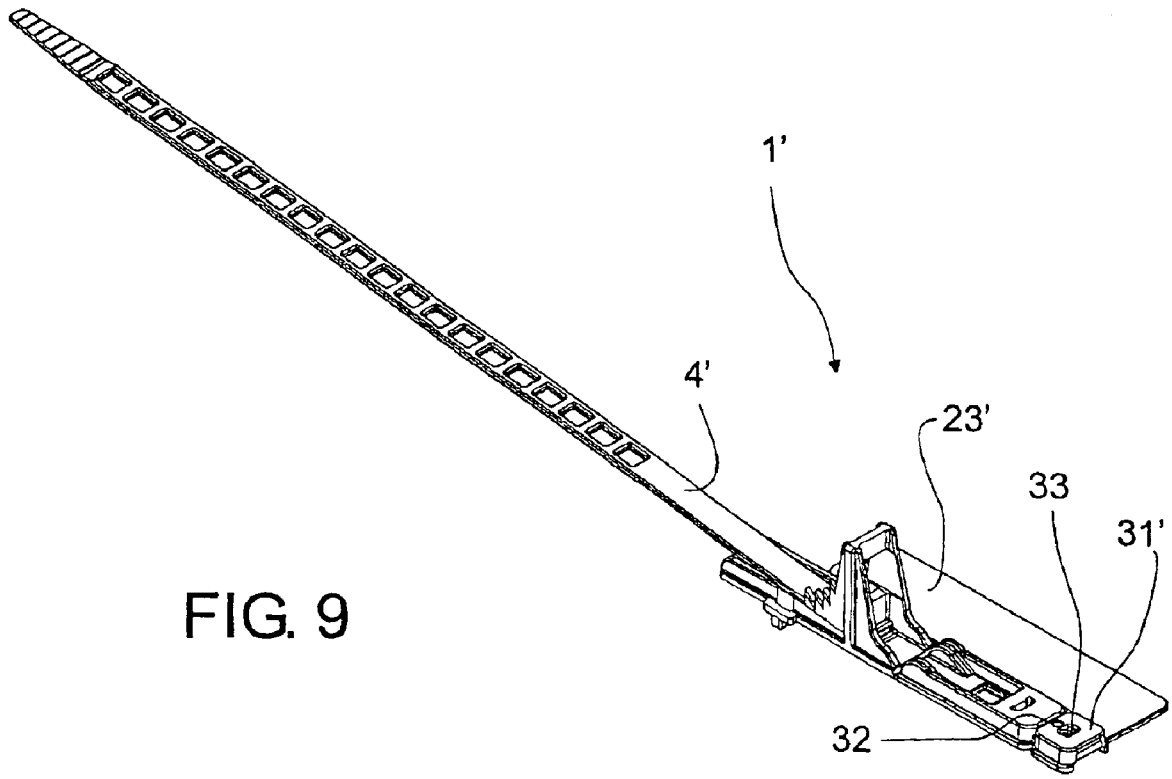
FIG. 9 is a lower perspective view of the seal illustrated in FIG. 8.
Figure 10:
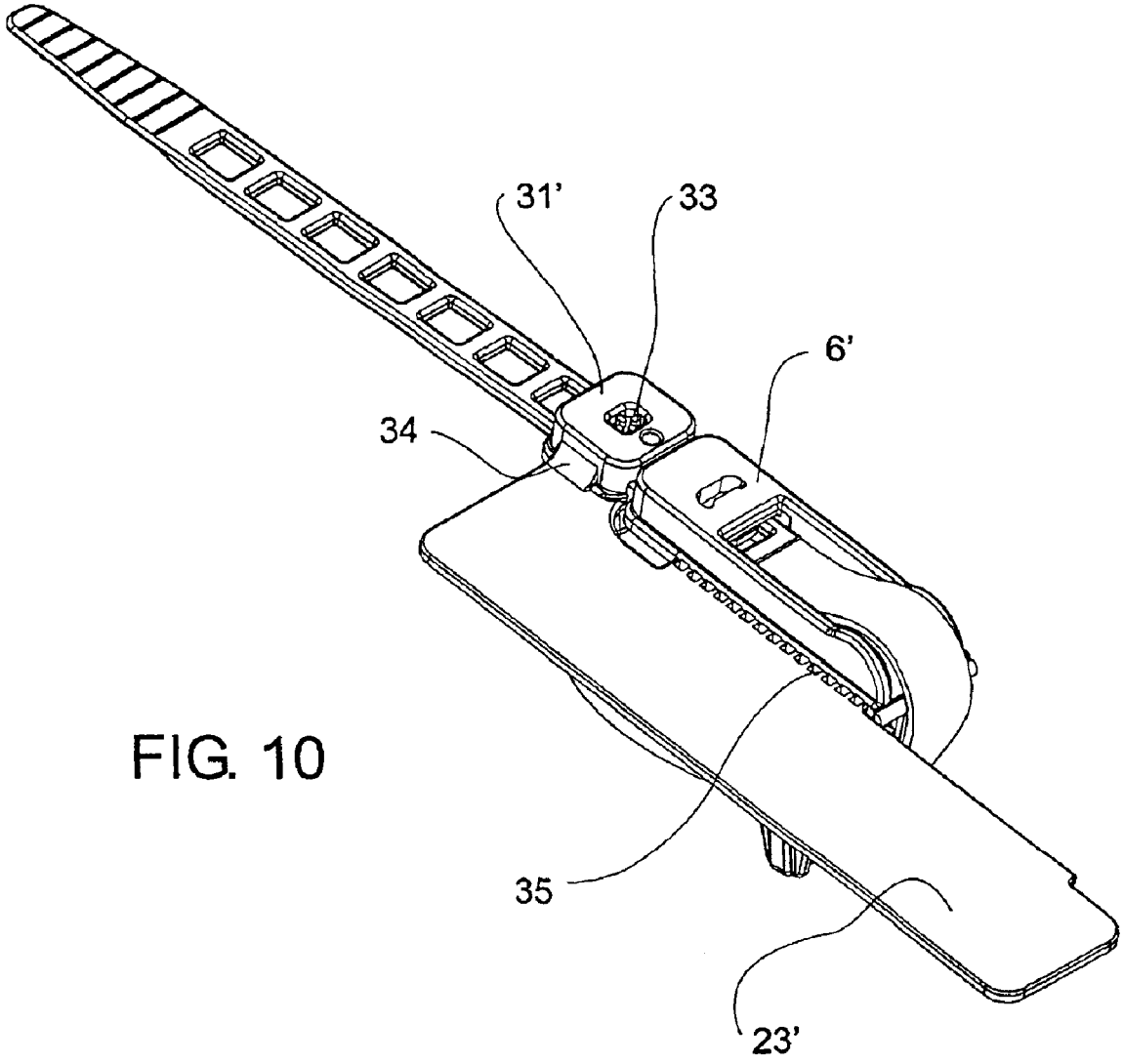
FIG. 10 is a perspective view of the seal of FIGS. 8 and 9, at the instant of closure.

FIGS. 8, 9 and 10 show a second embodiment of the seal according to the present invention. This seal differs from that described above due to the fact that it is truly throw-away in that it really can be used just once. However, it is extremely simple to apply, extremely efficient and even easier to open with destruction of the seal.

The seal of FIGS. 8 to 10 is very similar to that of FIGS. 1 to 3 and therefore, to facilitate understanding, the reference numbers differ only where there are differences in the configuration. Only the differences will now be described.

Referring now to FIGS. 8 to 10, seal 1' has a closure strap 4' that extends, not from the first end 3 of the operating portion, but rather from an approximately central region thereof, on the underside, adjacent flanges 8. Closure strap 4' may be manufactured as a separate part, being fitted into the region between flanges 8. The advantage of this configuration is that, when the neck of the bag or sack is of small diameter, the loop formed has a shorter straight part under operating portion 2, compared with seal 1 of FIGS. 1 to 3. This permits a tighter and more efficient closure.

Another important difference is that the end part 31' of lever member 6', distant from operating part 2, has a transverse wakening 32 that allows it to be torn off from the rest of the lever member, the already mentioned locking formation or security tooth 16' being joined to end 31 by means of a weakened base 33.

At the same time, the accessory or identification plate 23 of seal 1 of FIGS. 1 to 3 is substituted by an identification plate 23' that is strongly joined at 34 to end part 31 and joined laterally to the rest of lever member 6' by means of a weakening line 35.

FIG. 10 shows the seal 1' in the closed configuration. To open the seal, it is sufficient to hold the free end of plate 23' and pull it strongly upwards and to the left (in the drawing), breaking weakening line 35, separating the plate from the lever member 6' and then breaking the transverse weakening 32. This removes entirely the end part 31' of lever member 6' and, at the same time, breaks weakened base 33 of security tooth 16'. Tooth 16', thus separated from part 31' stays locked in cavity 19 in operating portion 2. The seal is thus destroyed and cannot be re-utilised. Opening of the seal is extremely simple and, once open, the seal is destroyed to an extent that it cannot be re-used illicitly.

It is to be understood that seal 1 and special seal 26 represent the invention in its presently preferred form. However, the invention should not be limited to the combination of all their characteristics as described and illustrated in the drawings or even to their equivalents, but rather to the aspects specifically defined in the claims.

What is claimed is:

1. A pull-tight one-piece security seal, adapted for closing bags or the like, comprising:

an operating portion having a first end and a second end and, between said ends, a contact region adapted for contacting a neck region of a bag;

a substantially flat closure strap, united at a first end to the operating portion, which extends away from the first end of the operating portion to a second free end, it being provided along its length with through-orifices that permit it to be immobilized in relation to the operating portion when it is passed around the neck of the bag to form a loop and the seal is closed; and a lever member extending from and integral with the second end of the operating portion at a hinge region, the lever member being foldable over the operating portion, on an opposite side of the latter in relation to the contact region, the lever member having a security locking formation for secure locking co-operation with a corresponding security locking formation on the operating portion when the seal is closed and the lever member further having a through-opening, spaced from said hinge region, for passage of the closure strap, and an immobilizing tooth for passing through and co-operating with one of the closure strap through-orifices to determine the effective length of the said closure strap when the seal is closed, at least one of the security locking formations passing through another of the closure strap through-orifices prior to said secure locking co-operation between the locking formations when said lever member is folded over the operating portion to tighten said loop.

2. Seal according to claim 1, wherein the region of contact with the neck of a bag, on the operating portion, defines a passage through which the closure strip is passed in forming the loop.

3. Seal according to claim 1 or 2, wherein the security locking formation on the lever member comprises a locking tooth, adapted to pass through another of the closure strap through-orifices, and the corresponding locking formation on the operating portion comprises a cavity adapted to receive said locking tooth in locking relation when the seal is closed.

4. Seal according to claim 1 or 2, wherein the first end of the closure strap is joined to the operating portion at a middle region of the latter, adjacent said contact region.

5. Seal according to claim 3, wherein the said locking tooth has a base fixing it to the lever member which is weakened so as to break on intentional opening of the seal, leaving a corresponding opening in the lever member.

6. Seal according to claim 5, combined with a separate security seal for sealing the one-piece seal during uses subsequent to the first use, when the locking tooth on the lever member is broken, the separate security seal comprising a plate to be placed over the lever member when the one-piece security seal is in a closed configuration for subsequent uses, and a protuberance in the form of a locking tooth substantially identical to the locking tooth that was broken, the locking tooth on the separate security seal also having a weakened base that can be broken on subsequent opening of the one-piece seal.

7. Seal according to claim 6, wherein the lever member is such that, in the closed position of the one-piece seal, it leaves at least one other of the closure strap through-orifices exposed, the separate security seal further having a locking means which, when it is applied to seal the one-piece seal in a subsequent use, passes through said one other of the closure strap through-orifices and elastically fixes the separate seal to the one-piece seal at a point remote from its locking tooth.

8. Seal according to claim 4, wherein the operating portion, adjacent said first end, has an elastic tooth adapted, in the closed configuration of the one-piece seal, to pass through one of the closure strap through-orifices and to catch itself therein so as to maintain the seal closed, the one-piece seal then being usable as a simple closure device without any security characteristics once the locking tooth on the lever member has been broken.

9. Seal according to claim 1, wherein the end of the lever member that is remote from the operating portion has a weakening that allows it to be torn off from the rest of the lever member, the security locking formation being joined to said end by means of a weakened joint.

10. Seal according to claim 9, wherein the remote end of the lever member is integral with a tab removably attached to the rest of the lever member.

* * * * *